US010928753B2

(12) United States Patent
Sabo et al.

(10) Patent No.: US 10,928,753 B2
(45) Date of Patent: Feb. 23, 2021

(54) SPRING IN A PRINTING FLUID DEVELOPER

(71) Applicant: HP INDIGO B.V., Amstelveen (NL)

(72) Inventors: David Sabo, San Diego, CA (US); John W. Godden, San Diego, CA (US); Alex DeRegules, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/487,754

(22) PCT Filed: Mar. 13, 2017

(86) PCT No.: PCT/US2017/022166

§ 371 (c)(1),
(2) Date: Aug. 21, 2019

(87) PCT Pub. No.: WO2018/169512

PCT Pub. Date: Sep. 20, 2018

(65) Prior Publication Data

US 2020/0233340 A1 Jul. 23, 2020

(51) Int. Cl.
*G03G 15/10* (2006.01)
*G03G 15/11* (2006.01)

(52) U.S. Cl.
CPC ..... *G03G 15/11* (2013.01)

(58) Field of Classification Search
CPC ..... G03G 15/10; G03G 15/11
See application file for complete search history.

(56) References Cited

U.S. PATENT DOCUMENTS

| | | | | |
|---|---|---|---|---|
| 3,716,221 | A | 2/1973 | Gorka et al. | |
| 4,595,280 | A | 6/1986 | Tanzawa et al. | |
| 4,982,239 | A | 1/1991 | Kume et al. | |
| 6,418,297 | B1 | 7/2002 | Yamatani et al. | |
| 7,391,988 | B2 | 6/2008 | Igarashi et al. | |
| 8,023,856 | B2 | 9/2011 | Okazaki et al. | |
| 2002/0009314 | A1 | 1/2002 | Nakayama | |
| 2013/0223888 | A1* | 8/2013 | Tanner | G03G 15/10 399/239 |
| 2014/0029971 | A1* | 1/2014 | Pingel | G03G 15/0898 399/103 |

FOREIGN PATENT DOCUMENTS

| | | | | |
|---|---|---|---|---|
| EP | 1679556 | A1 * | 7/2006 | G03G 15/11 |
| JP | 2001228738 | A | 8/2001 | |
| JP | 2002268394 | A | 9/2002 | |
| JP | 2006251421 | A | 9/2006 | |
| JP | 2008058616 | A | 3/2008 | |
| JP | 2008281651 | A | 11/2008 | |
| JP | 2013083968 | A | 5/2013 | |
| WO | WO-2013151562 | A1 * | 10/2013 | G03G 15/10 |
| WO | WO-2016053318 | A1 * | 4/2016 | G03G 15/10 |

* cited by examiner

*Primary Examiner* — Sophia S Chen
(74) *Attorney, Agent, or Firm* — Fabian VanCott

(57) ABSTRACT

A printing fluid developer that includes a developer roller; a cleaner roller forming a nip with the developer roller and held by a number of bearings at each end that are free to move within a slot towards and away from the developer roller; and at least one spring biased to force the bearings towards one side of the slot.

20 Claims, 7 Drawing Sheets

SPRING IN A PRINTING FLUID DEVELOPER

BACKGROUND

Printing systems such as liquid electro photographic printers may include printing fluid developer assemblies to selectively form images on a photoconductive member. The binary printing fluid developer assemblies include a plurality of rollers arranged in contact with respect to each other.

BRIEF DESCRIPTION OF THE DRAWINGS

The accompanying drawings illustrate various examples of the principles described herein and are a part of the specification. The illustrated examples are given merely for illustration, and do not limit the scope of the claims.

Figure 1:
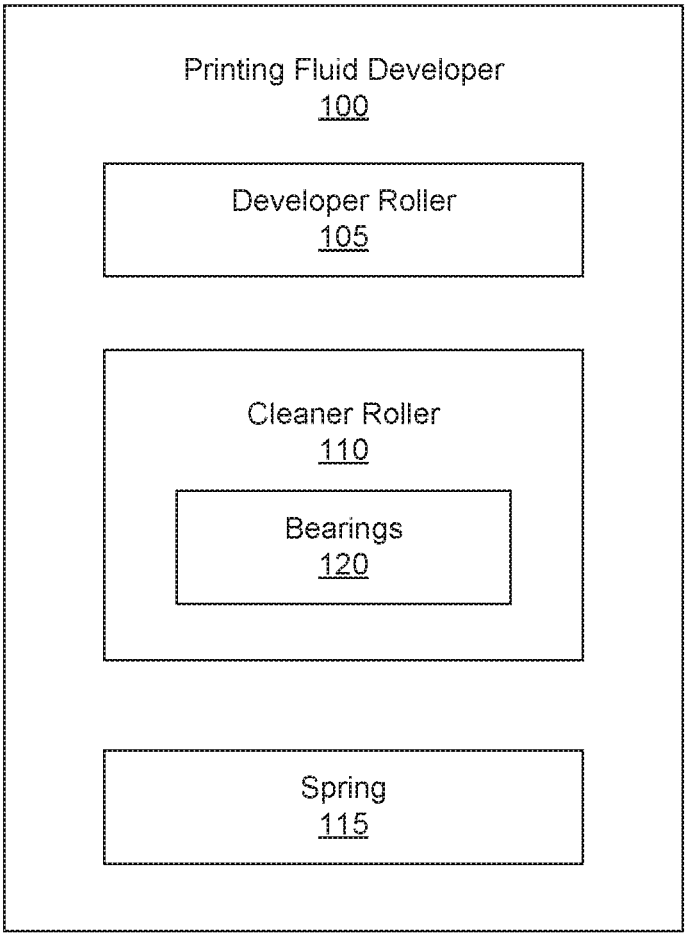
FIG. 1 is a block diagram of a printing fluid developer according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

As described above, printing systems and devices such as liquid electro photographic printing devices may include printing fluid developer assemblies to selectively form images on a photoconductive member. Each of the printing fluid developer assemblies may include any number of rollers in order to selectively place an amount of printing fluid onto a photoconductive member. The photoconductive member may then transfer that selectively applied printing fluid to a number of other rollers or to a sheet of media that is to receive that printing fluid.

In an example, each of the printing fluid developer assemblies may apply a distinct color of printing fluid such as liquid toner to the surface of the photoconductive member. In order to accomplish this, any number of printing fluid developer assemblies may be placed, circumferentially, around the cylindrical photoconductive member.

The various rollers in the printing fluid developer assemblies may include a developer roller and a cleaner roller. The developer roller may receive a printing fluid and transfer a portion of the printing fluid to a photoconductive member. The cleaner roller may remove an amount of unused printing fluid from the surface of the developer roller. In order to accomplish this, the interface between the developer roller and the cleaner roller form a nip. A nip is a squeezing interface between two rollers. In order to produce a relatively high quality print, the cleaner roller is to remove all or nearly all of the unused printing fluid from the surface of the developer roller so that a new layer of printing fluid may be applied. This new layer of printing fluid, in part, defines an image to be applied, eventually, to the surface of a print media. Consequently, any unused prating fluid remaining on the developer roller may be eventually delivered to the surface of the print media causing defects in the image.

In order to prevent this from occurring, the nip between the developer roller and the cleaner roller is to be maintained. This may be difficult where either the developer roller or the cleaner roller do not have a perfect circumference. Additionally, the deformities and tolerances associated with the nip between the cleaner roller and the developer roller may cause the cleaner roller to bounce off of the developer roller or vibrate due to the tolerances of the developer roller, cleaner roller, or other parts of the printing fluid developer assemblies.

The cleaner roller may be forced against the developer roller and may be held by ball bearings at either end. In an example, the bearings are constrained in a slot, defined in an endcap of the printing fluid developer, that allow freedom for the cleaner roller to move towards and away from the developer roller so that uniform nip can be maintained even with variations in the diameter and tolerances of the cleaner roller and developer roller.

Even further, the printing fluid developer assemblies may include a doctor blade that helps to remove an amount of unused printing fluid from the surface of the cleaner roller. The doctor blade does this by applying a force against the cleaner roller scrapping the unused printing fluid off from the cleaner roller. This force works to apply force to the cleaner roller to push it towards the developer roller. The forces from the doctor blade against the cleaner roller may be oriented in such a way that, under certain operating conditions, that the doctor blade biases the bearings coupled to the cleaner roller towards one side of the slot. In other operating modes, the doctor blade may bias the cleaner roller towards the other side of the slot. This variation in force orientation may cause the bearings to vibrate from side to side in the slot which can cause vibration of the cleaner roller against the developer roller. This may result in print defects due to failure to remove unused printing fluid from the developer roller by the cleaner roller or variations in the speed of the system due to unstable torque loads in the system due to the vibration.

The present specification therefore describes a printing fluid developer that includes a developer roller; a cleaner roller forming a nip with the developer roller and held by a number of bearings at each end that are free to move within a slot towards and away from the developer roller; and at least one spring biased to force the bearings towards one side of the slot.

The present specification also describes a system for preventing vibration of a cleaner roller that includes a printing fluid developer including a developer roller; a cleaner roller abutting the developer roller and including a bearing coupled to each side of the cleaner roller; a doctor blade to remove an amount of printing fluid from the cleaner roller; and at least one spring biased to force the bearings towards a side of a slot that the bearings are free to slide in.

The present specification further describes a printing system that includes a number of printing fluid developers to develop an image onto a surface of a photoconductive member, each of the number of printing fluid developers including a cleaner roller forming a nip with a developer roller and comprising a bearing coupled to each side of the cleaner roller; and a number of springs biased to force the bearings towards a side of a slot that the bearings are free to slide in.

Examples described herein provide for consistent force of the cleaner roller against the developer roller to form the nip so that the cleaner roller can clean the developer roller. The cleaner roller is stabilized preventing vibrations of the cleaner roller and, in turn, preventing banding print defects on a print media.

As used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

Turning now to the figures, FIG. 1 is a block diagram of a printing fluid developer (100) according to an example of the principles described herein. The printing fluid developer (100) may include a developer roller (105), a cleaner roller (110), and a spring (115).

The printing fluid developer (100) includes any number of electrodes. In an example, the number of electrodes is two: a first electrode and a second electrode. The first and second electrodes may be held at respective predetermined voltages such as, for example, a negative electrical potential, to influence the printing fluid within the printing fluid developer (100) to move to the developer roller (105). The negative potential can be, for example, −1500 volts, but could be some other potential. During operation, the fluidic printing fluid is made to migrate from the first and second electrodes to the developer roller (105) and selectively coat the developer roller (105). The developer roller (105) is held at a respective predetermined electrical potential. The electrical potential of the developer roller (105) may be less negative than any one of the number of electrodes. Example implementations can be realized in which the developer roller (105) is held at, for example, −450 volts, but could be some other suitable voltage.

During operation of the printing fluid developer (100), the developer roller (105) may have some printing fluid removed from the surface of thereof in order to selectively have a new layer of printing fluid applied thereon. The cleaner roller (110) accomplishes this by also being held at a predetermined electrical potential. Printing fluid that is not transferred from the developer roller (105) to, for example, a photoconductive member such as a photo imaging plate (PIP), is referred to as unused printing fluid. The cleaner roller (110) may be rotating in an opposite direction (counterclockwise) relative to the developer roller (105) in order to clean the developer roller (105) of any unused printing fluid.

To accomplish this, the cleaner roller (110) may be held at a predetermined potential that, in an example, is relatively less negative than that of the developer roller (105). For example, the cleaner roller's (110) predetermined potential can be −250 volts, but can be some other suitable voltage as well to achieve the functions described herein. In this way, the cleaner roller (110) cleans the unused printing fluid from the developer roller (105). In some examples, the electrical potential of the cleaner roller (110) may change over time in order to compensate for the age of the printing fluid developer (100), the relative resistivity of the other elements within the printing fluid developer (100), or some other parameters.

The cleaner roller (110) may further include a bearing (120) coupled to each side of the cleaner roller (110). In an example, the bearings (120) may be coupled to an axle of the cleaner roller (110). The bearings (120) may be allowed to move towards and away from the developer roller (105) to accommodate for the variations and tolerances in the developer roller (105) and cleaner roller (110). To provide for this free movement, an endcap at each end of the developer roller (105) and cleaner roller (110) may include a slot defined therein such that the bearings may move within the slot.

Because the cleaner roller (110) has an amount of unused printing fluid coating the surface of the cleaner roller (110), that unused printing fluid may be removed using, among other devices, a doctor blade. The doctor blade may be made of any resilient material that will bend against the cleaner roller (110). In an example, the doctor blade is bent such that a bias force is applied to the surface of the cleaner roller (110). The force produced by the doctor blade against the cleaner roller (110) pushes the cleaner roller towards the developer roller but may be oriented in such a way that the forces on the bearings (120) may bias the bearings (120) towards one side of the slot they are free to slide within during some operating modes and the other side of the slot during other operating modes. This may result in vibration of the cleaner roller which can prevent the nip between the developer roller (105) and the cleaner roller (110) from forming thereby reducing the cleaner roller's (110) ability to remove unused printing fluid from the developer roller (105). The vibration of the cleaner roller (110) may also create variations in the torque load used to drive the cleaner roller (110) which may result in speed instability. Consequently, this will result in banding print defects visible on a printed sheet of print media.

To overcome this variation in force of the cleaner roller (110) against the developer roller (105) and to ensure that the bearings (120) are securely biased to one side of the slot, the printing fluid developer (100) may include a number of springs (115). The springs (115) may apply a force against the cleaner roller (110) such that the bearings (120) are biased towards one side of the slot. The force of the springs (115) against the bearings (120) results in a force against the cleaner roller such that the nip between the developer roller (105) and the cleaner roller (110) is maintained during operation of the printing fluid developer (100). The force may also accommodate for any imperfections on the surfaces of the developer roller (105) and the cleaner roller (110).

In an example, the spring (115) may be made of an elastic material that is biased to return to its original shape once bent. In an example, the spring (115) may be made of steel. In an example, the spring (115) may be made of spring steel.

In an example, the cleaner roller (110) may include at least one bearing coupled to an axle of the cleaner roller (110). The springs (115) may interface with the bearing allowing the axle to freely rotate but also providing a force against the cleaner roller (110) such that the nip is formed between the developer roller (105) and the cleaner roller (110). In an example, a bearing may be placed on either end of the cleaner roller (110) and may be coupled to the axle of the cleaner roller (110).

In an example, the force applied to the cleaner roller (110) by the springs (115) may counteract that force applied to the cleaner roller (110) by the doctor blade. In an example, the force applied by the springs (115) to the cleaner roller (110) are normal to the force applied by the doctor blade to the cleaner roller (110). In an example, the force applied by the springs (115) to the cleaner roller (110) is not normal to the force applied by the doctor blade to the cleaner roller (110) but still counteracts an amount of force applied by the doctor blade to the cleaner roller (110). In any example, the force applied by the springs (115) to the bearings (120) biases the bearings (120) towards one side of the slot.

In an example, the printing fluid developer (100) may include a number of endcaps on each end of the cleaner roller (110). The axle of the cleaner roller (110) may pass through a number of holes defined in the endcaps and the number of bearings described herein may then be coupled to the ends of the axle of the cleaner roller (110). In this example, the springs (115) may be coupled to the endcaps such that they are able to engage the bearings and apply the force to the cleaner roller (110) as described herein. In an example, the springs (115) may use a portion of the body of the endcaps as a buttress from which to apply the force against the bearings. In an example, the body of the endcaps may include faces or connection points that the springs (115) may be coupled to in order to secure the springs (115) in position.

Figure 2:
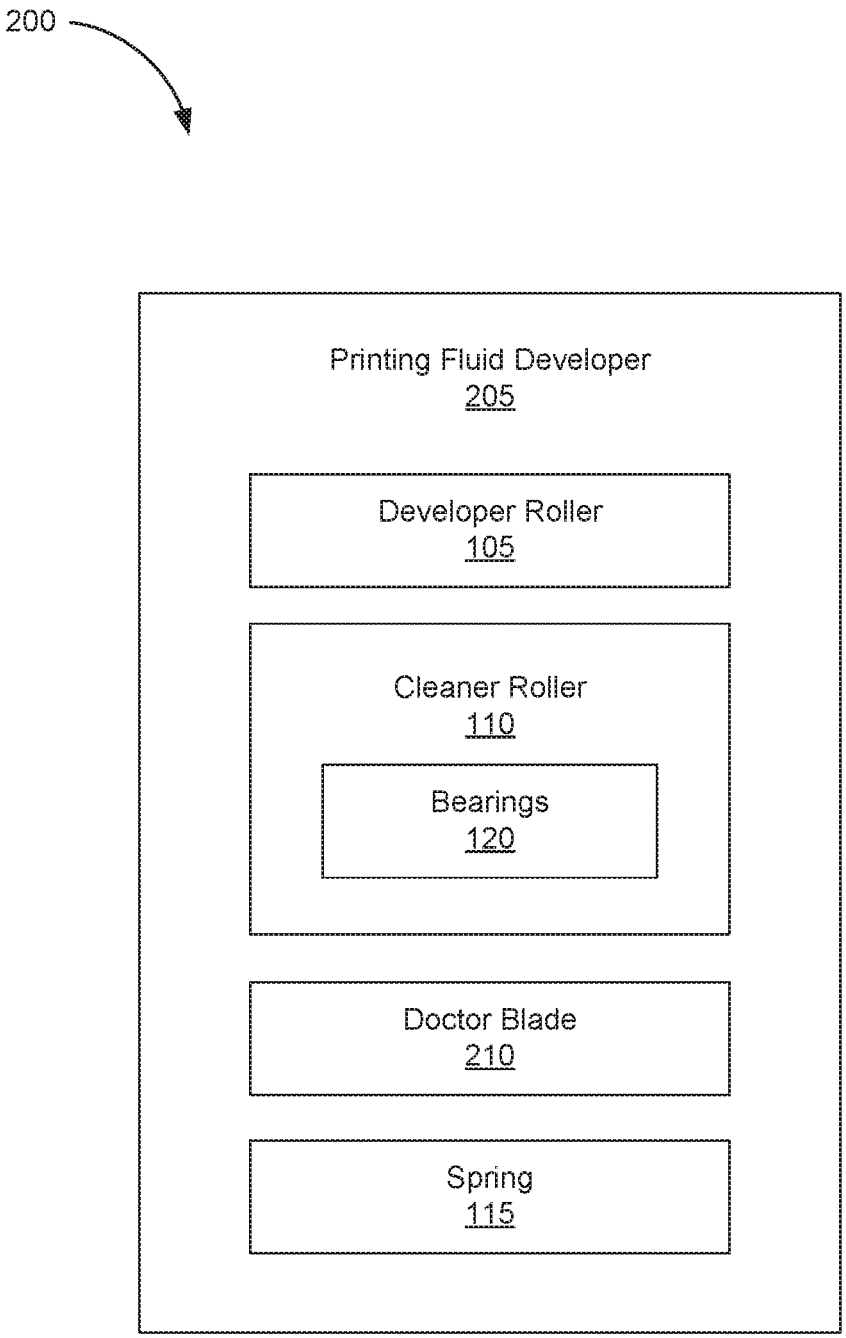
FIG. 2 is a block diagram of a system for preventing vibration of a cleaner roller according to an example of the principles described herein.

FIG. 2 is a block diagram of a system (200) for preventing vibration of a cleaner roller (110) according to an example of the principles described herein. The system (200) may include any number of printing fluid developers (205) orientated to provide an amount of printing fluid to the surface of a photoconductive member such as a photo imaging plate (PIP). The printing fluid associated with each of the number of printing fluid developers (205) may be different in type and/or color. In an example, the photoconductive member may be in the form of a roller and each of the printing fluid developers (205) may be positioned around the surface of the photoconductive member.

Each of the printing fluid developers (205) in FIG. 2 may include a developer roller (105), a cleaner roller (110), and a number of springs (115) as described above in connection with FIG. 1. Each of the developer roller (105), a cleaner roller (110), and a number of springs (115) may perform those functions and include those properties described herein. For ease of understanding, these features of the developer roller (105), a cleaner roller (110), and a number of springs (115) will not be described here.

The printing fluid developers (205) may further include a doctor blade (210), also known as a wiper blade. As described above, the doctor blade (210) may be used to physically remove an amount of unused printing fluid from the surface of the cleaner roller (110). To do so, the doctor blade (210) may scrape against the surface of the cleaner roller (110) against the direction of rotation of the cleaner roller (110). In so doing, the doctor blade (210) applies a force against the surface of the cleaner roller (110) which causes, in some situations, the bearings (120) to vibrate from side to side in the slot. Again, this causes the developer roller (105) to not be cleaned in some locations as the cleaner roller (110) vibrates against the developer roller (105) and further causes variation in torque loads that result in speed instabilities of the rollers. This, in turn, causes banding images to appear on a printed sheet of print media causing a poor-quality print. The spring (115) counteracts the force applied by the doctor blade to the cleaner roller (110) by pushing against the bearings (120) such that the bearings (120) are biased towards one side of the slot. This prevents the banding issue and provides for a relatively better quality print on the print media.

Figure 3:
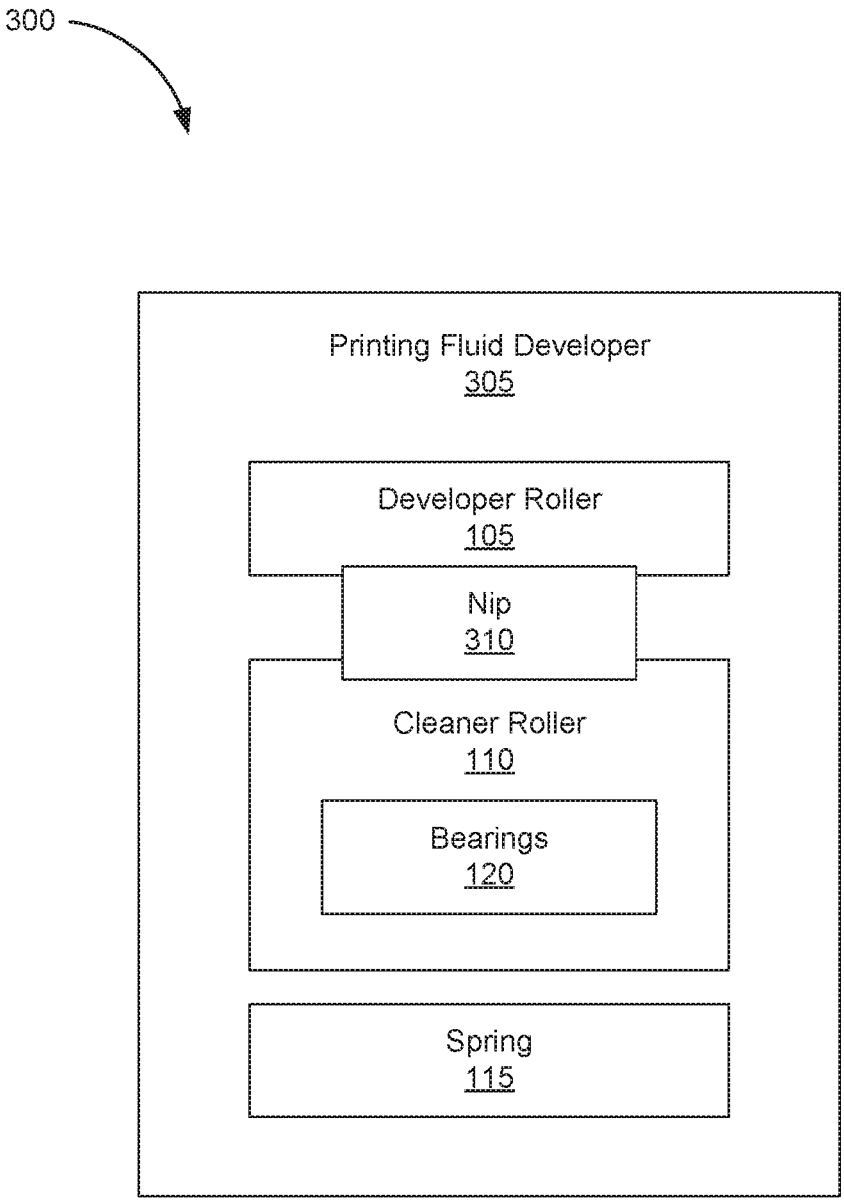
FIG. 3 is a block diagram of a printing system according to an example of the principles described herein.

FIG. 3 is a block diagram of a printing system (300) according to an example of the principles described herein. The system (300) may include any number of printing fluid developers (305) orientated to provide an amount of printing fluid to the surface of a photoconductive member such as a photo imaging plate (PIP). The printing fluid associated with each of the number of printing fluid developers (305) may be different in type and/or color. In an example, the photoconductive member may be in the form of a roller and each of the printing fluid developers (305) may be positioned around the surface of the photoconductive member.

Each of the printing fluid developers (305) in FIG. 2 may include a developer roller (105), a cleaner roller (110), and a number of springs (115) as described above in connection with FIG. 1. Each of the developer roller (105), cleaner roller (110), and a number of springs (115) may perform those functions and include those properties described herein. For ease of understanding, these features of the developer roller (105), a cleaner roller (110), and a number of springs (115) will not be described here.

The interface between the cleaner roller (110) and developer roller (105) is to be maintained such that the cleaner roller (110) cleans the developer roller (105). As described above, the cleaner roller (110) may have an electrical potential bias applied to it such that it can pull an amount of unused printing fluid from the surface of the developer roller (105). Without close contact with the developer roller (105), the electrical bias may not be enough to overcome any additional distance between the developer roller (105) and cleaner roller (110). The doctor blade (FIG. 2, 210) may apply force against the cleaner roller (110) in such a way that the bearings (120) vibrate from side to side in the provided slot that allows the bearings (120) to freely slide within. In some operating circumstances, this may prevent the development of a nip (310) between the developer roller (105) and cleaner roller (110) as described above reducing the effectiveness of the cleaner roller (110) to clean the developer roller (105). This may also introduce variations in torque that result in speed instability. The spring (115), however, counteracts the force applied by the doctor blade to the cleaner roller (110) and instead biases the bearings (120) to one side of the slot that they are free to slide in which thereby eliminating these vibrations. This further creates a consistent nip (310) between the developer roller (105) and the cleaner roller (110) thereby reducing speed instabilities.

Figure 4A:
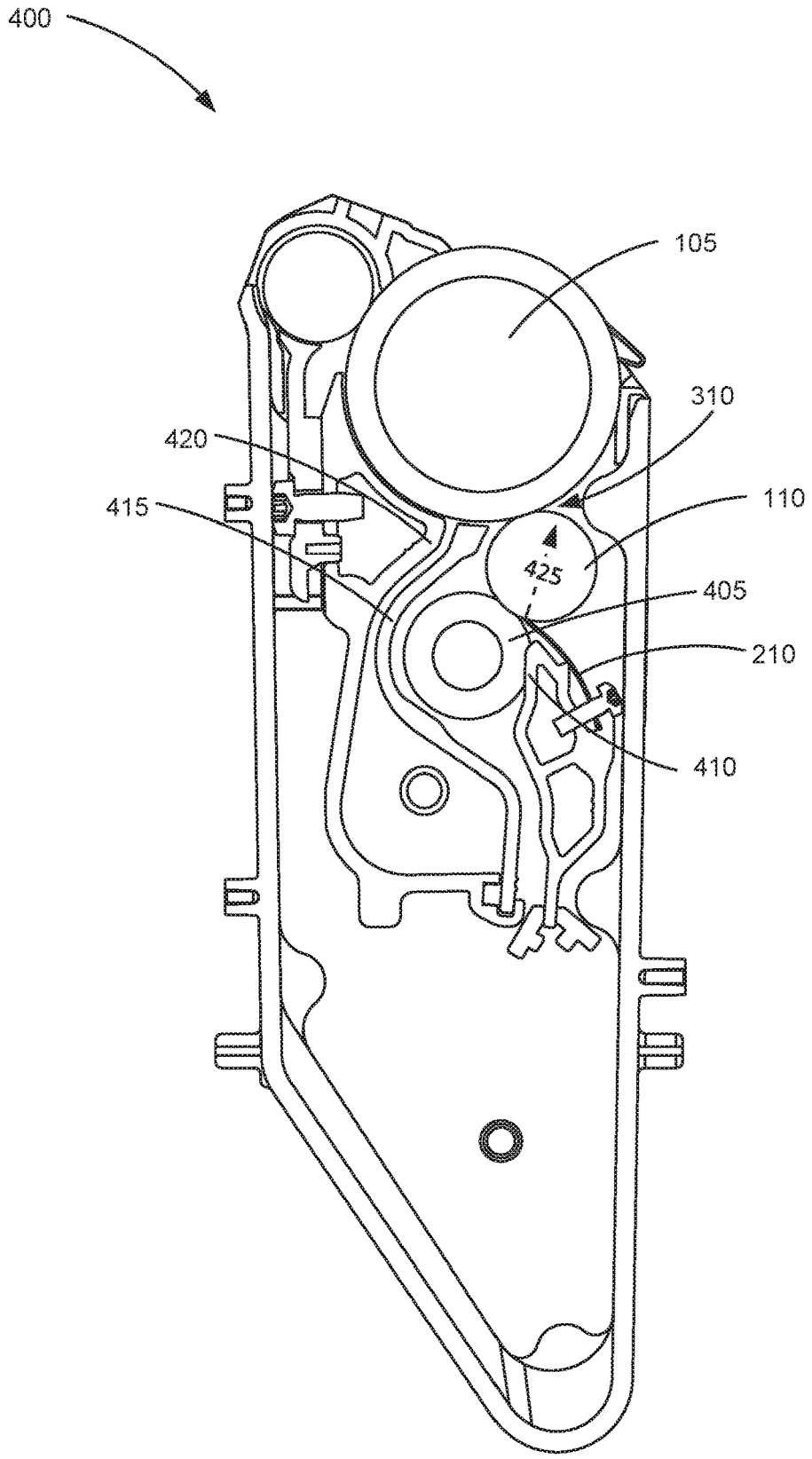
FIGS. 4A, 4B, and 4C show a side cutout view, a side view, and a side view, respectively, of a printing fluid developer according to an example of the principles described herein.
Figure 4B:
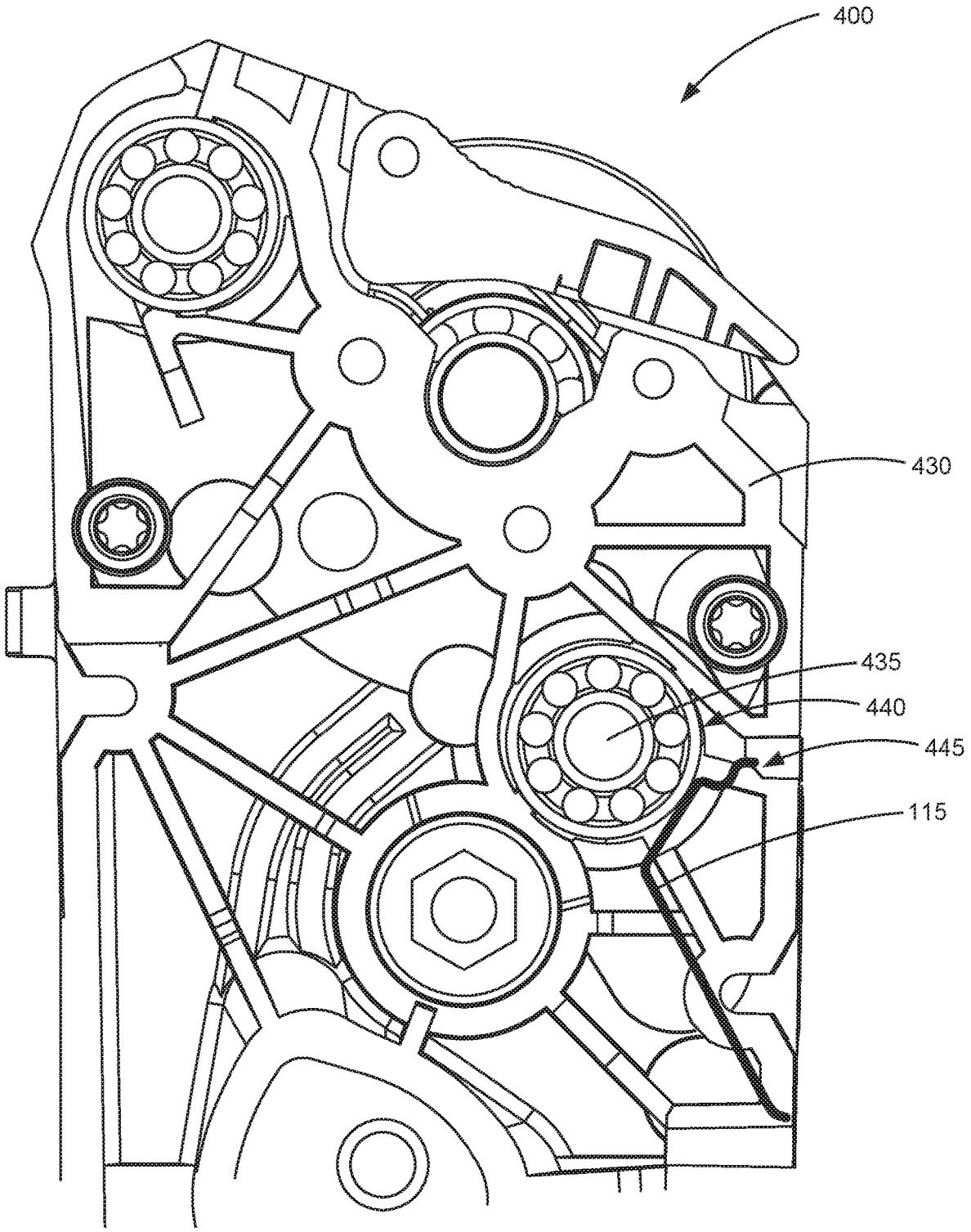
Figure 4C:
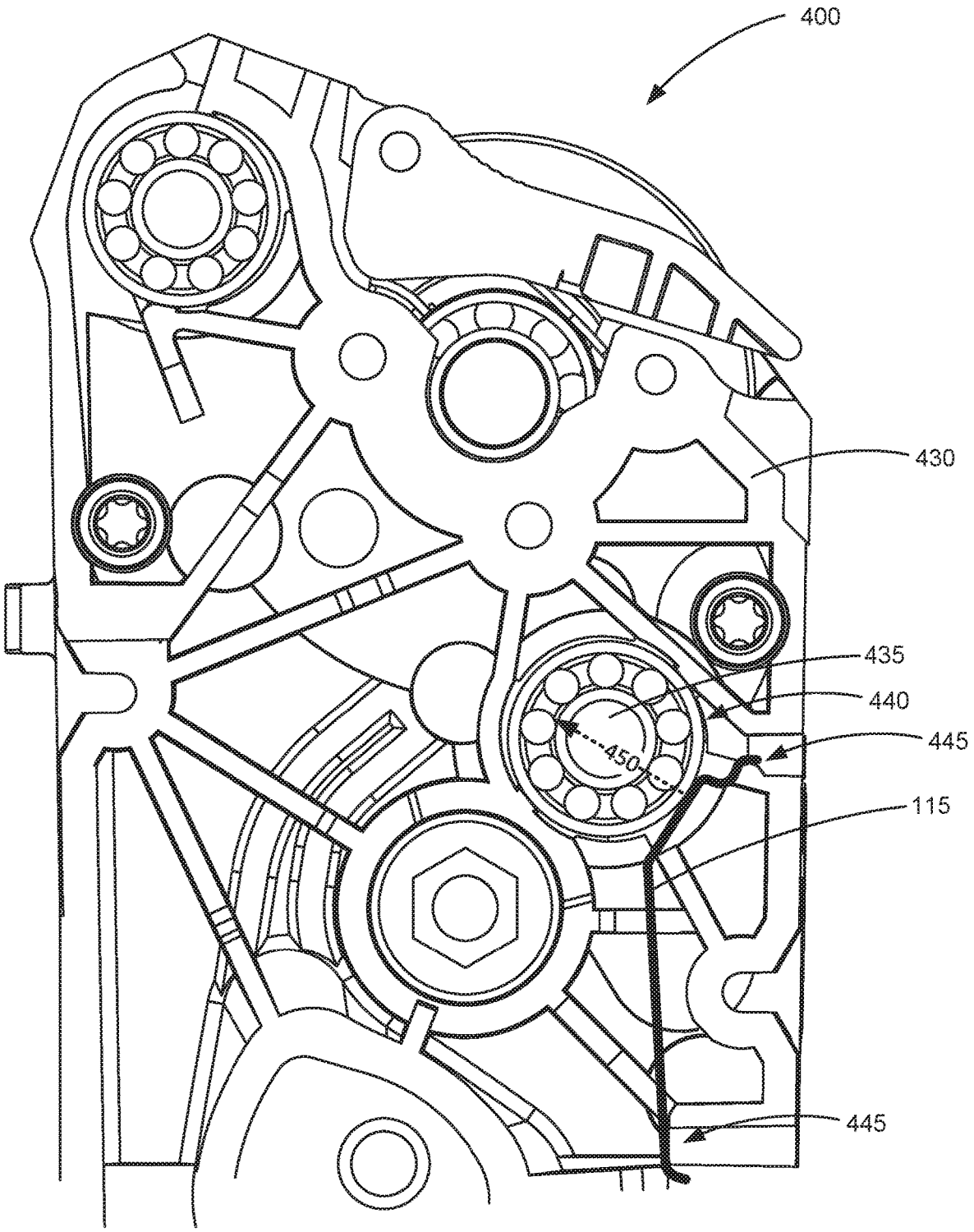

FIGS. 4A, 4B, and 4C show a side cutout view, a side view, and a side view, respectively, of a printing fluid developer (400) according to an example of the principles described herein. The printing fluid developer (400) may include the developer roller (105), cleaner roller (110), doctor blade (210), and nip (310) as described herein. Each of the developer roller (105), a cleaner roller (110), doctor blade (210), and nip (310) may perform those functions and include those properties described herein. For ease of understanding, these features will not be described here.

The printing fluid developer (400) may further include a sponge roller (405) to help clean unused printing fluid from the surface of the cleaner roller (110), a wiper wall (410) to squeeze an amount of printing fluid from the sponge roller (405), a first (415) and second (420) electrode to apply an electrical potential bias on the developer roller (105) as described herein. As can be seen in FIG. 4A, the doctor blade (210) is elastically biased on the surface of the cleaner roller (110) such that the doctor blade (210) applies a force against the cleaner roller (110) as indicated by the dashed doctor blade force arrow (425).

FIG. 4B shows the printing fluid developer (400) of FIG. 4A with an endcap (430) coupled to the end of the printing fluid developer (400). Another endcap (430) may be place on an opposite side the printing fluid developer (400) and may include similar elements as those shown in FIG. 4B. As described above, an axle (435) of the cleaner roller (110) may be extended through the endcap (430). A bearing (440) may be coupled to the end of the axle (435) to allow the axle (435) to turn freely relative to an exterior surface of the bearing (440).

The spring (115) may be positioned such that a portion of the spring (115) contacts the outer surface of the bearing (440). As shown in FIG. 4B, the spring (115) is in a biased state such that no force is applied to the outer surface of the bearing (440). A top portion of the spring (115) may be coupled or otherwise fastened to a portion of the endcap (430) at a spring coupling point (445). FIG. 4C shows the spring (115) in a biased position such that a force is applied to the outer surface of the bearing (440). Additionally, a second end of the spring (115) may be caused to abut another spring coupling point (445) thereby producing the biased force of the spring (115) against the outer surface of the bearing (440). Dashed spring force arrow (450) indicates, generally, the direction of force applied to the bearing (440) and cleaner roller (110) by the spring (115). As can be seen from FIGS. 4B and 4C the force of the spring (115) may counteract the force of the doctor blade (210) thereby causing the bearings (120) to be forced towards one side of the slot that the bearings (120) are free to slide in. In the example shown in FIG. 4C, the bearings (440) are biased towards a lower left area of the slot, with the slot running generally parallel with the direction of the force (450) the spring (115) applies to the bearing (440).

Figure 5:
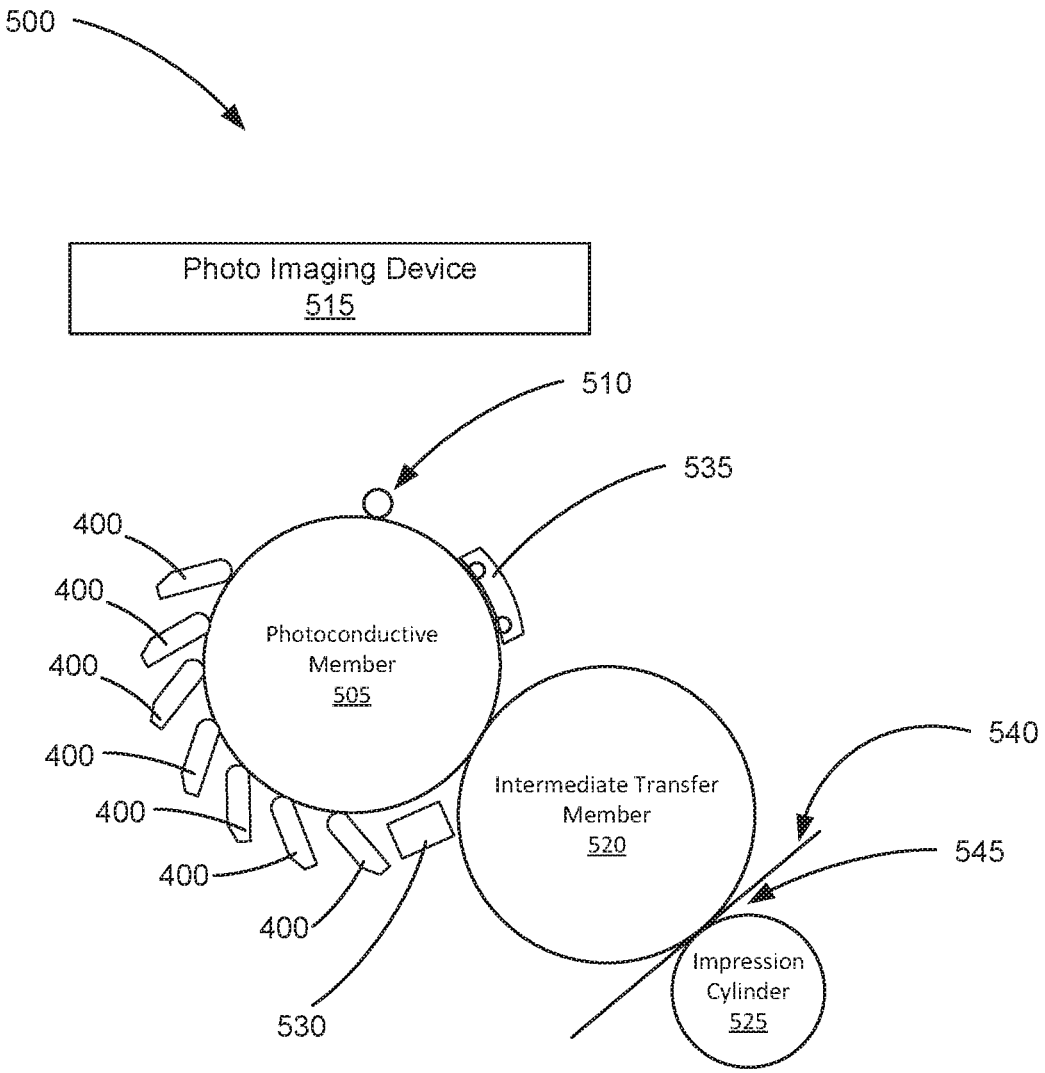
FIG. 5 is a diagram of a printing system (500) implementing a plurality of printing fluid developers (400) according to an example of the principles described herein.

FIG. 5 is a diagram of a printing system (500) implementing a plurality of printing fluid developers (400) according to an example of the principles described herein. FIG. 5 shows specifically the layout of a number of printing fluid developers (400) oriented around a photoconductive member (505) such as a PIP. As described above, each of the printing fluid developers (400) may be oriented differently around to the photoconductive member (505) such that the orientation of each of the printing fluid developers (400) may vary from vertical to horizontal.

Along with the other elements described in connection with the printing fluid developers (400) described herein, the system (500) may further include the photoconductive member (505), a charging device (510), a photo imaging device (515), an intermediate transfer member (ITM) (520), an impression cylinder (525), a discharging device (530), and a cleaning station (535). The printing fluid developers (400) are disposed adjacent to the photoconductive member (505) and may correspond to various colors such as cyan, magenta, yellow, black, and the like. The charging device (510) applies an electrostatic charge to a photoconductive surface such as the outer surface of the photoconductive member (505). A photo imaging device (515) such as a laser exposes selected areas on the photoconductive member (505) to light in a pattern of the desired printed image to dissipate the charge on the selected areas of photoconductive member (505) exposed to the light.

For example, the discharged areas on photoconductive member (505) form an electrostatic image which corresponds to the image to be printed. A thin layer of printing fluid is applied to the patterned photoconductive member (505) using the various printing fluid developers (400) to form the latent image thereon. The printing fluid adheres to the discharged areas of photoconductive member (505) in a layer of printing fluid on the photoconductive member (505) and develops the latent electrostatic image into a toner image, the toner image is transferred from the photoconductive member (505) to the ITM (520). Subsequently, the toner image is transferred from the ITM (520) to the print medium (540) as the print medium (540) passes through an impression nip (545) formed between the ITM (520) and the impression cylinder (525). The discharging device (530) removes residual charge from the photoconductive member (505). The cleaning station (535) removes toner residue in preparation of developing the new image or applying the next toner color plane.

The specification and figures describe a spring used in a printing fluid developer that causes a cleaner roller to maintain a nip with a developer roller. The spring provides a counterforce against the force applied to a cleaner roller by a doctor blade that biases bearings coupled to the cleaner roller towards one side of a slot they are free to slide in. Additionally, the spring prevents the bearings from vibrating from side to side in the slot they are made to freely slide within thereby preventing banding images being produced on a sheet of print media. Consequently, implementation of the printing fluid developer described herein provides for relatively better image development on a developer roller, photoconductive member, and/or print media.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printing fluid developer, comprising:

a developer roller;

a cleaner roller forming a nip with the developer roller and held by a number of bearings at each end that are free to move within a slot towards and away from the developer roller; and at least one spring biased to force the bearings towards one side of the slot.

2. The printing fluid developer of claim 1, wherein the cleaner roller comprises at least one bearing coupled to a first end of the cleaner roller and wherein the at least one spring interfaces with the bearing.

3. The printing fluid developer of claim 2, wherein the number of bearings is two with a bearing being coupled to each of the first end and a second end of the cleaner roller.

4. The printing fluid developer of claim 3, wherein the at least one spring comprises two springs, with a spring interfacing with the bearing on each end of the cleaner roller.

5. The printing fluid developer of claim 1, wherein a doctor blade removes an amount of printing fluid from a surface of the cleaner roller.

6. The printing fluid developer of claim 5, wherein the at least one spring counteracts a force applied by the doctor blade.

7. The printing fluid developer of claim 1, wherein the slot is formed in an endcap of the printing fluid developer.

8. The printing fluid developer of claim 1, wherein the at least one spring is made of stainless steel.

9. The printing fluid developer of claim 1, wherein the at least one spring is coupled to an endcap of the printing fluid developer.

10. The printing fluid developer of claim 1, wherein the at least one spring comprises a spring with end portions fastened to a support structure, a center portion of the spring in contact with one of the number of bearings at an end of the cleaning roller.

11. A system for preventing vibration of a cleaner roller, comprising:

a printing fluid developer comprising:

a developer roller;

the cleaner roller abutting the developer roller and comprising a bearing coupled to each side of the cleaner roller;

a doctor blade to remove an amount of printing fluid from the cleaner roller; and at least one spring biased to force the bearings towards a side of a slot that the bearings are free to slide within.

12. The system of claim 11, wherein the at least one spring applies the force to the cleaner roller via at least one bearing coupled to a terminal end of the cleaner roller.

13. The system of claim 11, wherein the slot is formed in an endcap of the printing fluid developer.

14. The system of claim 11, wherein the at least one spring is made of steel.

15. The system of claim 11, wherein the at least one spring counteracts a force applied by the doctor blade.

16. A printing system, comprising:

a number of printing fluid developers to develop an image onto a surface of a photoconductive member, each of the number of printing fluid developers comprising:

a cleaner roller forming a nip with a developer roller;

a number of bearings, a bearing coupled to each side of the cleaner roller; and a number of springs biased to force the bearings towards a side of a slot that the bearings are free to slide in.

17. The printing system of claim 16, wherein each of the number of printing fluid developers further comprises a doctor blade to remove an amount of printing fluid from the surface of the cleaner roller.

18. The printing system of claim 17, wherein the slot is formed in an endcap of each printing fluid developer.

19. The printing system of claim 17, wherein a spring of the number of springs counteracts a force applied by the doctor blade.

20. The printing system of claim 16, wherein each of the number of printing fluid developers further comprises at least one bearing coupled to a terminal end of the cleaner roller, each bearing abutting a spring of the number of springs.

* * * * *